US006354235B1

(12) United States Patent
Davies

(10) Patent No.: US 6,354,235 B1
(45) Date of Patent: Mar. 12, 2002

(54) CONVOY OF TOWED OCEAN GOING CARGO VESSELS AND METHOD FOR SHIPPING ACROSS AN OCEAN

(76) Inventor: Robert C. Davies, 2003 SE. 158th Loop, Vancouver, WA (US) 98683

( * ) Notice: Subject to any disclaimer, the term of this patent is extended or adjusted under 35 U.S.C. 154(b) by 0 days.

(21) Appl. No.: 09/364,709

(22) Filed: Jul. 30, 1999

(51) Int. Cl.[7] ..... B63H 25/00
(52) U.S. Cl. ..... 114/246; 440/33
(58) Field of Search ..... 114/242, 246, 114/249, 250, 247; 440/33

(56) References Cited

U.S. PATENT DOCUMENTS

| | | | | |
|---|---|---|---|---|
| 1,014,313 A | | 1/1912 | Macklind | |
| 1,578,626 A | | 3/1926 | Baer | |
| 3,353,512 A | * | 11/1967 | Mathews et al. | 114/250 |
| 3,730,123 A | * | 5/1973 | Lang | 114/278 |
| 3,800,733 A | | 4/1974 | West | |
| 3,871,323 A | * | 3/1975 | Roseman et al. | 114/251 |
| 3,892,196 A | | 7/1975 | Swoboda, Jr. et al. | |
| 4,275,677 A | * | 6/1981 | Nelson | 114/246 |
| 4,452,163 A | | 6/1984 | Ayeva | |
| 4,890,568 A | * | 1/1990 | Dolengowski | 114/246 |
| 4,947,779 A | * | 8/1990 | Grinde | 114/250 |
| 5,215,483 A | * | 6/1993 | Whitworth | 440/38 |

FOREIGN PATENT DOCUMENTS

| | | | |
|---|---|---|---|
| CA | 1262215 | * 10/1989 | 114/246 |
| WO | 8200622 | * 3/1982 | 114/250 |

OTHER PUBLICATIONS

"Radar Navigation and Underwater Sound Systems/Radar Principles," Donald G. Fink and Alexander A. McKenzie, *Electronic Engineers' Handbook*, First Edition, pp. 24–34–25–37.

"Scope and Conditions of Classification," *Rules for Building and Classing Steel Vessels Under 90 meters (295 feet) in Length*, Part 1, Section 1, Copyright 1997, American Bureau of Shipping; 4 pages.

*Encyclopedia of Nautical Knowledge*, W.A. McEwen and A.H. Lewis, Copyright 1953, Cornell Maritime Press; Library of Congress #53–9685; pp. 370, 484, 487.

*International Maritime Dictionary*, by Rene de Kerchove, Second Edition, Van Nostrante Reinhold Company, Copyright 1948, 1961, bu Litton Education Publishing, Inc., p. 545.

* cited by examiner

*Primary Examiner*—S. Joseph Morano
*Assistant Examiner*—Andrew Knight
(74) *Attorney, Agent, or Firm*—Marger Johnson & McCollom, PC; Gregory T. Kavounas

(57) ABSTRACT

A ship convoy is provided that is towed by an ocean tug, and includes a series of specially made ocean going, modular, self propelling cargo ships, for transoceanic voyages. The tug also controls the cargo ships remotely. Each cargo ship is a medium tonnage, independently powered, independently controllable, freight carrying vessel with an oceanworthy hull. The hulls preferably have a standardized external design, which makes them modular. Inside, each has cargo space for either generic cargo, or for special cargo, such as refrigerated cargo or containers. Their engines need be no more powerful than is required for river navigation, but with a tank that holds enough fuel for a transoceanic voyage. The special cargo ships go up a river preferably using autonomous navigation. Upon reaching a port, the cargo ship is loaded, and then exits the river. Then it is combined with the tug and the other cargo ships for the transoceanic voyage.

18 Claims, 9 Drawing Sheets

CONVOY OF TOWED OCEAN GOING CARGO VESSELS AND METHOD FOR SHIPPING ACROSS AN OCEAN

BACKGROUND OF THE INVENTION

1. Field of the Invention

The present invention is related to the field of maritime transportation, and more specifically to shipping cargo across oceans using combinations of ships.

2. Description of the Related Art

The basic cargo freighter ship is the primary tool for transporting large amounts of goods across oceans. It is characterized by a monohull design and highly efficient diesel propulsion.

The economics of cargo transportation across oceans suggest increasing the size of the monohull design. That is because there are logistical efficiencies in shipping a large cargo at once, even though that makes the ship more expensive. Accordingly, the size of the cargo bays has been increasing, which in turn has presented technical problems.

A larger hull, as compared to a smaller hull, is subjected to disproportionate structural punishment by the waves encountered in the ocean. This is because of the inevitable larger length, and the frequent larger height of the larger hull.

The hull stresses are now described with reference to FIGS. 1–5. Referring to FIG. 1, a ship 50 rides at the top of a wave 52. The hull is subjected to vertical forces 54 and horizontal forces 56. The forces deform the hull towards assuming shape 58. The deformation is also known as "hogging".

Referring to FIG. 2, ship 50 rides at a bottom of a wave 62. The hull is subjected to vertical forces 64 and horizontal forces 66. The forces deform the hull towards assuming shape 68. The deformation is also known as "sagging".

Referring to FIG. 3, ship 50 rides in a changing wave 72. The hull front and rear portions of the hull are subjected to opposite torsional forces 74, 76. The forces tend to deform the hull in a twisting motion.

Referring to FIG. 4, ship 50 is in the loading process in the calm water line 80 of a port. Two loads 82, 84, press the hull unevenly, causing downward vertical forces 86. The water counteracts them by causing upward vertical forces 88. The vertical forces apply shear to the hull, and deform it accordingly.

It will be appreciated that these forces are disproportionately large when the ship length is large. In addition, another type of deformation is because of the large ship height.

Referring to FIG. 5, ship 50 is turning, while even in calm water 90. Its tall hull is subjected to a horizontal force 92. Accordingly, it is deformed towards assuming shape 94. The deformation is also known as "racking".

These deformations cause fatigue to the hull plates, which reduces the service life of the overall vessel. The deformations are dealt with by strengthening crucial junctions and support members between the hull sections and plates. This strengthening elevates design costs, manufacturing costs and maintenance costs of these vessels.

Additionally, the large shipping capacity of a single ocean going ship has increased other costs to those who ship cargo. The larger capacity makes it more likely that more cargoes will be combined. Combining cargoes in order to fill a large capacity ship imposes delays in shipping of those cargoes which arrive early at the port dock, relative to those which arrive late. This increases shipping costs, both on actual cash terms, and consumes more of the life of the product.

A problem identified by the inventor is that there has always been a cost for local shipping. Local shipping is transporting goods from the place of their production to the transoceanic port of origin. This cost includes loading, shipping, unloading, and storing, until the large cargo ship is ready for loading. This is a built in cost, whether local shipping is done by railroad or by river. This cost has been unavoidable so far, and increases the expense of shipping.

A common ocean going freighter can not be used to alleviate the burden of local shipping. To do this, it would have to visit local ports. First, it would rarely be economical to do so, except perhaps between large ports. Second, it is often physically impossible to go into rivers. Even though a river may be wide enough, it is usually not deep enough for the large draft of the freighter. And even if deep enough, it may have a low bridge over it, which the ship's superstructure would not clear.

BRIEF SUMMARY OF THE INVENTION

The present invention overcomes these problems and limitations of the prior art.

Generally, the present invention provides an oceantrain. An oceantrain is a convoy of an ocean tug generally towing a series of specially made cargo ships also called module ships. In some instances the ocean tug simply controls the cargo ship remotely, without being physically coupled with them.

Each cargo ship is a medium tonnage, independently powered, independently controllable, freight carrying vessel with an oceanworthy hull. The hulls preferably have a standardized external design, which makes them modular. Inside, each has cargo space for either generic cargo, or for special cargo, such as refrigerated cargo or containers. Their engines need be no more powerful than is required for river navigation.

Being of medium tonnage, the special cargo ships have low draft, and thus can go up a river preferably using autonomous navigation. Each has a minimum pilot accommodation, which reduces the required overhead, and can clear a bridge. Having a short length and low draft, they are very maneuverable.

Reaching a port in the river, the special cargo ship can be loaded locally, and then exit the river and go to a port of origin of a transoceanic journey. While waiting for that journey to start, there is no need to unload, store, or reload the cargo. This eliminates a portion of costs that so far were always present.

A number of module ships gathered in a port of origin are then grouped into an oceantrain. They are connected with each other end to end, with special couplers for towing. The oceantrain is completed with a special ocean tug, which provides additional power for the ocean voyage. Further, the ocean tug controls each of the towed vessels by a remote control system. As such, once the oceantrain is assembled, the pilot of each cargo ship is no longer needed. They can use a catwalk suspended under the coupler to walk up to the tug, for disembarking before the ocean voyage starts.

While crossing the ocean, the tug tows the series of the cargo ships. In addition, the engine of each cargo ship is running, and is further controlled by the tug. Controlling the power, braking, and turning of each cargo ship makes the whole oceantrain move like one unit, and under the direction of a single captain.

During the voyage, controlling is by electrical wire, and preferably by radio signals that may go through satellite. Thus the cargo ships can be controlled even when disengaged from the towed convoy. For going through short locks or other situations, the oceantrain can be disengaged into sections. The sections can travel alongside each other, while still remotely controlled by the tug. They can be recoupled once clearing the situation.

Once the ocean voyage is completed, the ocean train can be disassembled at the port of destination. Each cargo ship can be individually piloted to its destination for unloading. Some of these destinations may be upstream a navigable river, that an ocean going cargo freighter might not be able to reach due to its large draft and higher overhead.

The oceantrain accomplishes transoceanic voyages with smaller hulls. The smaller size results in less deformation, and therefore less fatigue. As such, the module ships have a greater service life than those of ocean freighters. Stresses are absorbed in the couplers, which are economical to replace.

The modularity of the individual module ships permits assembling quickly an oceantrain with diverse types of cargoes. This results in shorter waiting times for each type of cargo, which improves the economics of shipping every type of cargo.

The ability to use the ocean going hull past the transoceanic port of destination, e.g. also for river transportation, will alleviate the bottleneck at the ocean ports, and thus will offer more options to shippers. Schedules will become more flexible, and transportation by river, sea and ocean a more attractive option. The economics of shipping will change, especially for shipping a refrigerated cargo, or a chemical cargo that needs special containment.

The invention includes numerous other features and advantages. They will become more readily apparent from the following detailed description of a preferred embodiment, which proceeds with reference to the drawings.

DETAILED DESCRIPTION OF THE PREFERRED EMBODIMENT(S)

Figure 1:
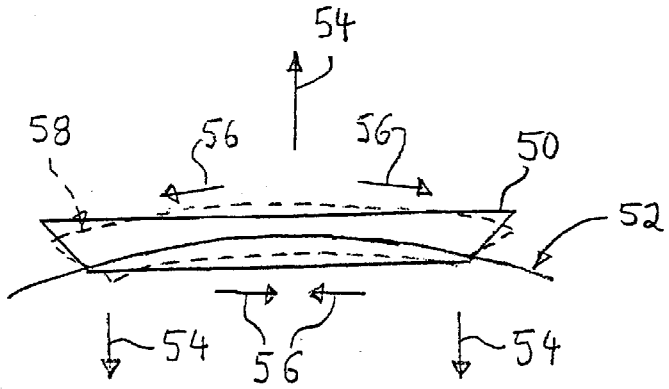
FIG. 1 (PRIOR ART)
FIG. 1 is a drawing of a prior art ocean going ship subjected to hogging.

As has been mentioned, the present invention provides an oceantrain. An oceantrain is a convoy of an ocean tug towing a series of specially made cargo ships. The invention is now described in detail also referring to the drawings.

Overview

Figure 6:
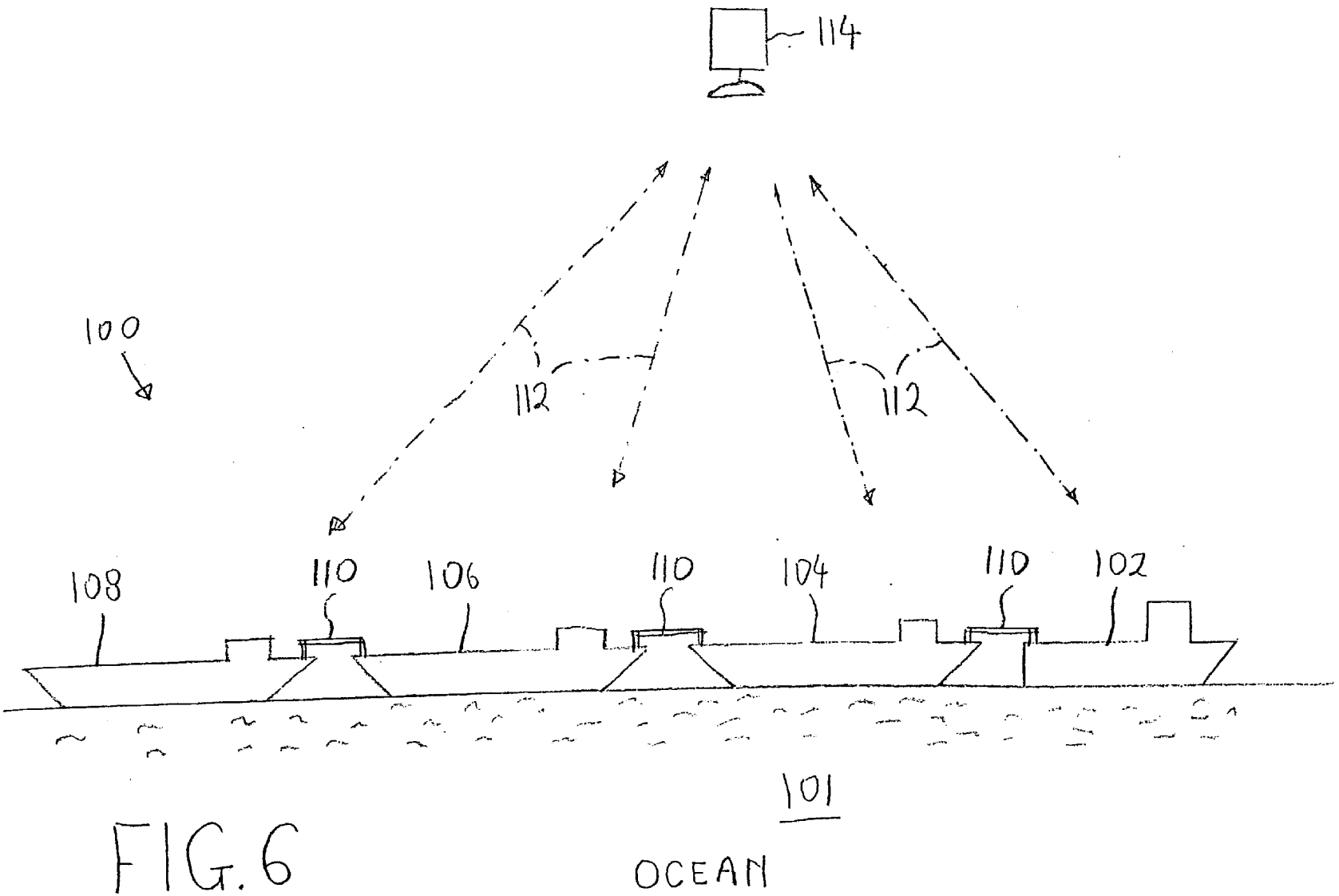
FIG. 6 is a side view of an oceantrain made according to the invention.

Referring to FIG. 6, an oceantrain 100 traveling on ocean 101 is shown made according to the invention. The ocean train includes an ocean tug 102 and three specially made cargo ships 104, 106, 108. First ship 104 is coupled to the tug and carries a first portion of the cargo, and second ship 106 is coupled to first ship 104 and carries a second portion of the cargo. In addition, a third ship 108 is coupled to second ship 106 and carries a third portion of the cargo.

The cargoes in each ship can be portions of the same paid for cargo, or diverse cargoes assembled simply for the convenience of crossing the ocean together. For carrying these cargoes, there is no theoretical limit to the number of towed ships of the convoy that makes the ocean train.

The ships of the oceantrain are coupled with couplers 110. This ensures that the tug tows the cargo ships, although that is sometimes discontinued, as will be seen below. Further, the ships have communication links between them, preferably by each having a communication link 112 with a space based satellite 114.

The towed cargo ships are also preferably self propelled, although that is not required. Some of the cargo ships can be passive barges, lacking engine propulsion. This, however, imposes higher power requirements on the tug of the oceantrain.

The ships all move as one. Even when a section is uncoupled, its ships can be controlled to move in the same direction as the tug. In spite of its large aggregate tonnage, the ocean train has great stopping power, because all the engines can be aligned to be used together for stopping.

The individual ships are new described.

The Ocean Tug

Figure 7:
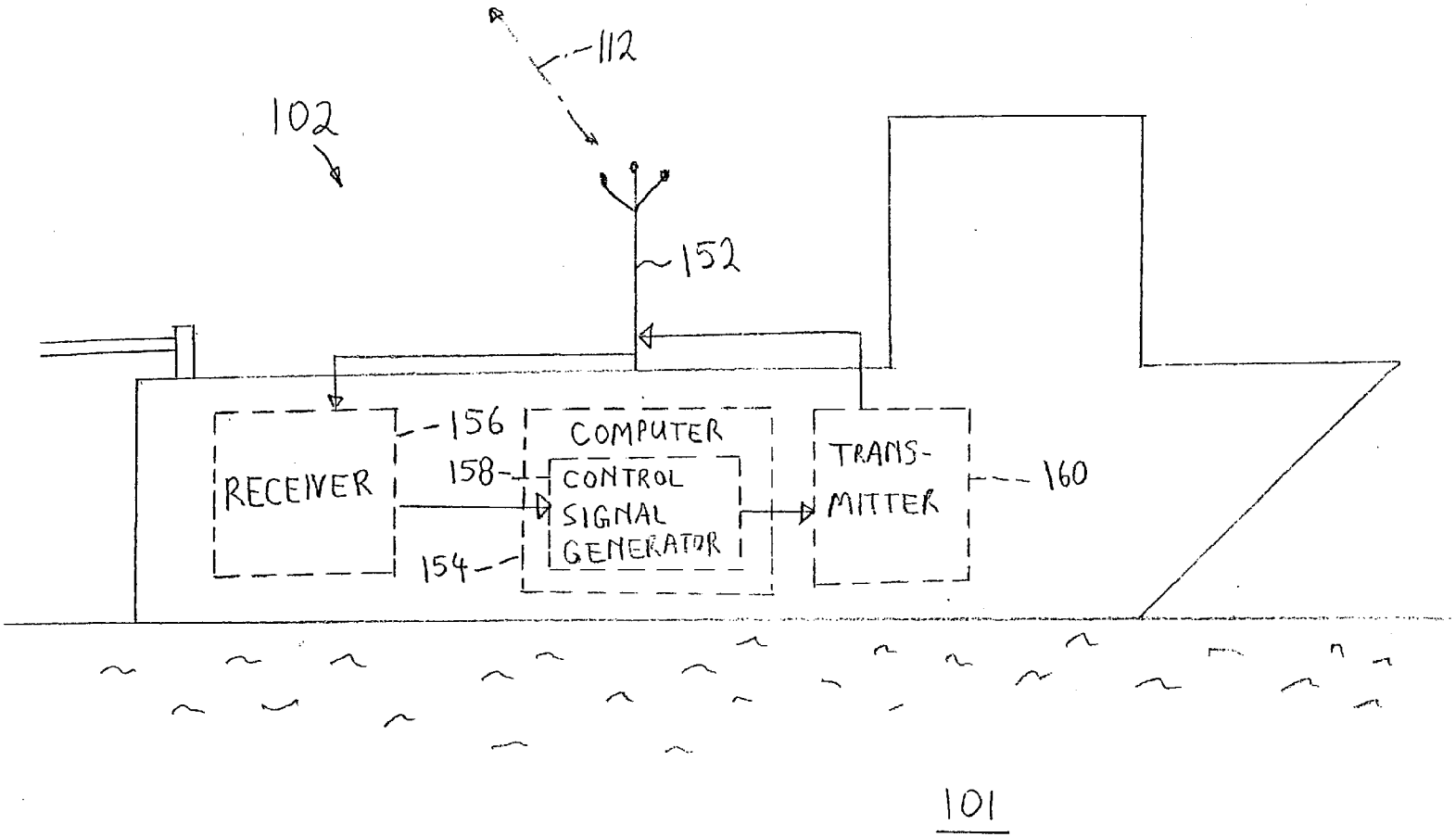
FIG. 7 is a combination of a side view of an ocean tug made according to the invention along with a block diagram of some of its components.

Referring to FIG. 7, ocean tug 102 of the invention, also referred to simply as tug, is now described in more detail. The tug is made as is known in the art for ocean going tugs, with additional features as per the invention. The additional features are only described where it is necessary. The person skilled in the art of naval design will be able to fill in the details given the present description. A definition of a prior art ocean tug is given at least in the International Maritime Dictionary, Kerchove, $2^{nd}$ Edition, 1961 Litton Educational Publishing. There an "ocean tug" is a type of tug specially designed for long distance tows at sea, where seaworthiness, considerable power, and ample fuel capacity are required.

Firstly, the tug is made powerful enough to tow self propelling cargo ships through the ocean. To compute this amount of power, the characteristics of the cargo ships (drag, power) are first computed individually. Then they are computed collectively, in order to determine the applicability of a specific tug for a proposed voyage. These calculations can be greatly simplified in the future, if a standard external shape and size is developed for the cargo ships. Then each tug of the invention can be rated in terms of simply the number of self propelling cargo ships it can tow for an ocean voyage. A rule of thumb is that the tug should power itself plus provide 40% of the power for each cargo ship of the whole oceantrain. The remaining 60% will be provided by each cargo ship.

Planning the load of the tug can include advantageously an allowance for the possibility that the engine of one of the cargo ships is temporarily out of order. The engine could be repaired while the voyage of the whole oceantrain is continuing.

Secondly, the tug of the invention includes equipment for controlling the towed cargo ships. Controlling these ships involves communicating with them. Detailed communication systems are explained in more detail below. It will be appreciated that, in the preferred embodiment, the tug becomes a control ship for each and every one of the cargo ships. That is true for the oceantrain whether the ships are actually physically coupled, or temporarily disconnected.

As can be seen in FIG. 7, tug 102 contains additional communications and control equipment. This additional equipment is used for interacting with the other ships of the oceantrain, and is described in more detail below.

The Specially Made Cargo Ships

Figure 8:
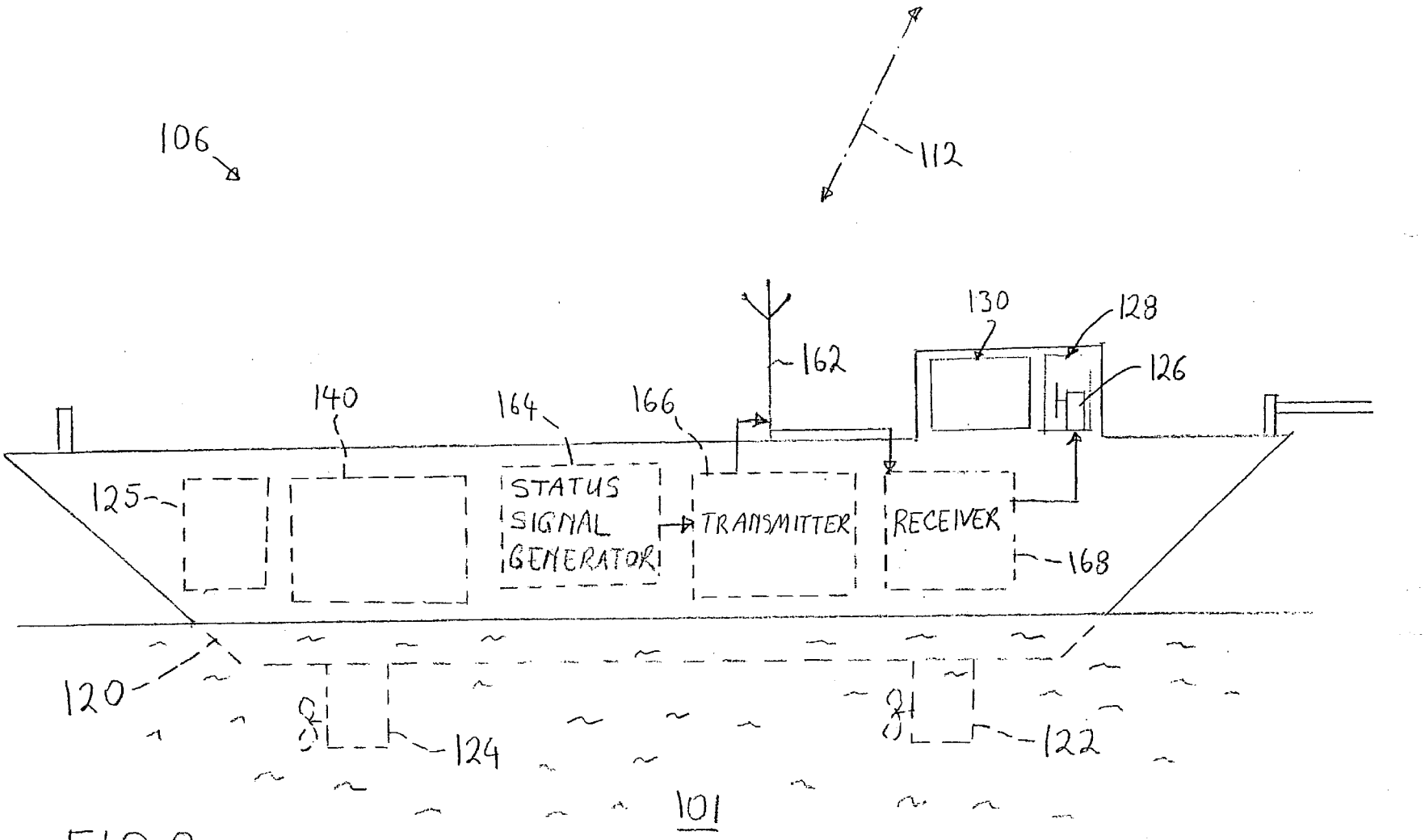
FIG. 8 is a combination of a side view of a cargo ship made specially according to the invention along with a block diagram of some of its components.

Referring now to FIG. 8, the specially made cargo ships of the invention are described. They are also called module ships. Each module ship preferably has an average displacement between 3,000 and 6,000 tons. It is capable of operating in the world's oceans, navigable rivers, canals and waterways. The overall design can be from different combinations of frontal area, drag coefficients, horsepower to weight ratios, fuel consumption ratios, control surface dimensions and strength of materials analyses.

Each cargo ship has a hull 120. The hull is preferably like that of a small ship, with a relatively sharp bow, medium chine and a square transom. Further, the hull is oceanworthy. For construing the scope of this document, the hull of a vessel is oceanworthy if it meets any one of the following definitions:

The hull is oceanworthy if the vessel is "ocean going". A vessel is ocean going if, in the usual course of her employment, navigates seaward of the line of demarcation between inland waters and high seas. That is, it navigates towards the ocean.

A vessel is also oceanworthy when it has a hull specially designed and constructed for prolonged journeys in ocean waters. More specifically, a vessel is termed oceanworthy when it meets a reasonably safe and proper condition in which the vessel's hull and equipment, her cargo and stowage thereof are deemed adequate to undertake prolonged ocean voyages in the high seas.

As will be apparent to a person skilled in the art, making a hull oceanworthy entails special design considerations. The hull would be more durable than the hull of a ship intended merely for transportation through river waters, and relatively close to the seashore. Still, the hull may have to comply with applicable local rules. One example is the Rules for Building and Classing Steel Vessels Under 90 meters (295 feet) in Length, available by the American Bureau of Shipping, Two World Trade Center, $106^{th}$ Floor, New York, N.Y. 10048, U.S.A., which are hereby incorporated by reference.

It is notable that this definition of oceanworthy is about the hull, not the whole module ship of the invention. The definition does not extend to requiring that the engine be that of an ocean going vessel. A vessel can have a hull that makes it oceanworthy, but its engine can be less than correspondingly powerful.

Cargo ship 106 preferably includes at least one engine for propelling the hull. The engine is located in the hull, or within the hull. The engine needs to be powerful enough for travel in river waters. However, the engine does not need to be powerful enough for the ocean trip, since the tug will provide additional propulsion. This economy is an important aspect of the present invention.

The engine can be a marine diesel engine. It can include a drive propeller, two lateral thrusters, and 4 rudders for maneuvering. In the preferred embodiment, two azipod-type engines 122 and 124 are preferably used. As is known, an azipod type engine has a propeller that can be rotated towards any direction. By providing two, one at the front and one at the rear the movement of the cargo ship is controlled better, especially when it is part of the ocean train. The rotation also eliminates the need of a separate rudder.

The cargo ship also includes a fuel tank 125. Tank 125 has a capacity for enough fuel supply for the engine to run continuously for the entire transoceanic voyage. Although it is most beneficial if the engine is continuously running for the entire voyage, that is not necessary. In any event, it is preferred that tank 125 can contain enough fuel for the engine to run continuously without refueling for ten days and nights, i.e. 240 hours. This tank is much larger than is typically required for traveling in river waters.

The cargo ship also generally includes navigation implements. These generally control the steering gear, the engine such as the throttle, etc. In general, they control a direction of movement of the hull.

The cargo ship of claim preferably further includes on board controls 126, such as an engine throttle, etc. These controls 126 can be operated to override all other control signals that are received from a control ship. As such, these can be operated to control a movement of the whole cargo ship autonomously. This can be done manually by an on board pilot (not shown) stationed in a pilot station 128 to control the navigational implements. This feature is used when the hull is physically uncoupled from the control ship, and intended to be operated autonomously. One example is when the oceantrain is decomposed into segments, and the lead ship of each segment controls (although that is not necessary, because they can all be controlled remotely). Another example is for the short river trips. Then a small pilot quarter 130 permits overnight pilot accommodation.

Since ship 106 is for transporting cargo, hull 120 defines a cargo space 140 (shown smaller than relative size), along with accommodations for it (opening for loading and unloading, etc.). The cargo space can be generic, or adapted for special cargo, e.g. containers. The cargo space can be further specially adapted to include a refrigerated cargo capability, e.g. by including proper equipment and thermal containment as is known in the art for cargo ships. Alternately the cargo space can be adapted for a chemical containment capability, for chemical commodities that are toxic or plain harmful to the environment (e.g. petroleum products). The cargo space is adapted as is known in the art for cargo spaces of prior art ocean going ships, except to a smaller scale of a ship typically between 3,000 and 6,000 tons displacement. The prior art teaches that it does not pay to make special ships this small, for the reasons discussed above.

The cargo space of the invention is smaller than equivalent spaces of present day ocean going cargo ships. With the smaller cargo space comes smaller width and shallower draft. The cargo ship of the invention can go up a river, and load a cargo that does not need to be large to economically justify the trip. The special cargo does not need to be unloaded, stored and then reloaded onto another ocean going cargo ship, along with similar cargo, which makes it more economical.

Communication Systems

Ship 106 further includes additional communications and control equipment. This additional equipment is used for interacting with the other ships of the oceantrain, and is described in more detail below.

A preferred feature of the oceantrain of the invention is that the ships include communication systems for communicating in addition to the general towing. The communication systems are used to better control all the ships to act as one unit.

The communication systems include communication links between the ships. Preferably the links include a direct umbilicus trunk cable for carrying electrical signals. The cable is made from multi-wire line sections that span each cargo ship (from bow to stern), and branch off to each ship. The towing couplers include multi-wire line sections that run parallel. When the ships become coupled by the couplers, the line is then completed by plugging in rugged line connectors at the end of each line section. If the ships are uncoupled, the line connectors can be individually unplugged, although that is not necessary. They will become unplugged automatically without damage, which is very useful in an urgent situation.

The preferred embodiment of the invention is made with the recognition that ocean travel is different from river travel. First, since temporary disengagement is also envisioned during travel, a backup wireless communication becomes imperative. Second, due to the height of the ocean waves, communication based on a line of sight (such as with radio) may not work always. That is why it is preferred that the signals travel through a satellite.

There are many ways for using a satellite. One such way is by using dedicated satellite systems. Another is by renting satellite services. Another is by using common wireless commercial telephone lines at least in part, which in turn use a satellite.

There are a number of ways of using telephone lines. For example, each ship can be assigned a telephone number, and connection can be by signals transmitted over a modem through to a common wireless telephone mechanism. The mechanism is the same as is known for wireless telephones, with enhanced power (from the ship's battery) for a larger signal strength.

Alternately, each ship can be connected to the internet via a wireless telephone. Signals can be transmitted by electronic mail also known as email. Since email is not necessarily transmitted in real time, each signal should be time stamped if small changes in position are to be accounted for, in controlling the ships with respect to each other.

A satellite based communication need not be turned on all the time. It can be employed when an electrical cable based communication is insufficient.

Further, in all kinds of wireless transmissions, the signals are preferably encrypted uniquely for the oceantrain, and also for individually addressing each ship. This will prevent outright tampering or innocent confusion between different oceantrains, or ships of a single oceantrain.

In the preferred embodiment of the invention the tug is also the control ship of the oceantrain. Only this embodiment is described. Given the present description, a system can be designed where control of one or more of the cargo ships of the oceantrain can be transferred to any one or more of the cargo ships. This is especially useful where the ocean train is decomposed into sections for traveling through short locks or other situations. In that case, the cargo ship heading its section can become the control ship for its section until recoupling.

Referring back to FIG. 7, the communication systems of tug 102 include an antenna 152. The antenna can be part of a wireless telephone system as described above.

Tug 102 typically includes a ship computer 154. This receives Global Positioning System (GPS) signals with information about the tug's position, which is used in plotting and correcting the course of the whole oceantrain. The systems described below can be implemented as software in the computer, as shown. In that case, if a telephone line is being used, the signals can be coupled between the computer and the telephone line by a modem.

Tug 102 includes a wireless receiver 156 that receives status signals from the cargo ships through antenna 152. The receiver decodes and decrypts if necessary the status signals. This yields operational status information of the transmitting cargo ship. The operational status information includes information such as position, throttle power, rudder orientation or equivalent. Other types of status information are optionally additionally included, as described below.

Tug 102 further includes a control signal generator 158. The control signal generator generates control signals that contain navigational commands for controlling the movement of the cargo ships that receive them. The control signals are generated by taking into account the positions and velocities of the ships. The control signals are such that the ships are controlled to the maximum maneuvering advantage of the oceantrain. The control is automated, so that it can be performed on a continuous automatic basis, without being tended to. The captain of the tug thus becomes the captain of the whole oceantrain.

Tug 102 also includes a wireless transmitter 160 that transmits the control signals to the cargo ships through antenna 152. The transmitter encodes and encrypts if necessary the control signals.

Referring back to FIG. 8, the communication systems of cargo ship 106 includes an antenna 162. The antenna can be part of a wireless telephone system as described above.

Cargo ship 106 includes a status signal generator 164. The status signal generator generates status signals that contain operational status information, such as present throttle power, rudder orientation or equivalent of the transmitting cargo ship. Other types of status information are optionally additionally included, for example, engine readouts. In addition, the cargo ship preferably includes a GPS receiver. This generates position information, which is added to the status information.

Cargo ship 106 also includes a wireless transmitter 166 that transmits the status signals to the cargo ships through antenna 162. The transmitter encodes and encrypts if necessary the status signals.

Cargo ship 106 further includes a wireless receiver 168 that receives control signals from tug 102 through antenna 162. The receiver decodes and decrypts if necessary the control signals. This yields navigational commands issued by the tug. The received navigational commands are applied for controlling the navigation implements of cargo ship 106. Therefore, a movement of the hull is controlled by the tug. The output of the receiver is preferably routed through on board controls 126.

As with the above, the receiver, generator and transmitter of ship 106 can be implemented as software in a ship computer at least in part, as will be readily determined by a person skilled in the art. These work together with the corresponding components of the tug. When designing, communication protocols need to be decided, etc. When operating, first a communication link is established, then a handshake confirming compatibility of communication protocol, etc.

A person skilled in the art will be able to implement the above described system of the invention in view of the "Locotrol" technology that has been in use for land based trains for 30 years. There the lead locomotive transmits wirelessly control signals to helper locomotives that are located dozens of wagons away. The control signals control an operation of the helper locomotives through an interface. An analogous application is to interface for such control signals to control the navigational implements of the cargo ship.

The person skilled in the art will further appreciate that many of the systems are interchangeable. For example, antenna 152 of the tug in FIG. 7 can be made the same as antenna 162 of cargo ship 106 in FIG. 8. In practice, a single communication and control system can be standardized, and each ship can come filly equipped to control or be controlled by others. This will automatically prevent any protocol incompatibility problems.

Couplers

In the oceantrain of the invention, adjacent ships are coupled to each other with couplers. In each case, the coupler is attached to the hull of the towed ship and to the hull of the towing ship. The coupler for coupling cargo ships can be the same as the coupler for coupling the tug. Accordingly, towing is through the coupler.

Couplers can be made as is known in the art. Each includes an elongate portion and two joints. The elongate portion provides separation. The joints attach the ends of the elongate portion to the hulls.

The tug is provided with a joint in the stem. Further, each cargo ship is provided with one joint at the front and one at the rear. Additionally, it is preferred that each cargo ship is provided with its own elongate portion, stowed near the bow of the ship. It can be already connected to the joint at the bow, and preferably easy to connect to the joint at the stern of the towing vessel. Standardization as to the components of the couplers is highly desirable.

A multi-wire line section, used for electrical communication, is carried by the elongate portion of the coupler. The cable terminates with electrical connectors near the joints. When the coupler is connected, the connectors are found easily for connection to a line section that spans the cargo ship from joint to joint.

A person skilled in the art will appreciate the improved performance of the invention as compared to the prior art. As described above with reference to FIGS. 1–5, there were large forces on the hull of prior art ship 50. These had become disproportionately large because the length of the ship approached a wavelength comparable to that of the waves.

These forces are applied to the oceantrain of the invention. But a large portion of them now stresses the couplers, not the hulls. The latter are now small compared to the wavelength. In addition, being smaller, they are affected disproportionately less.

Figure 2:
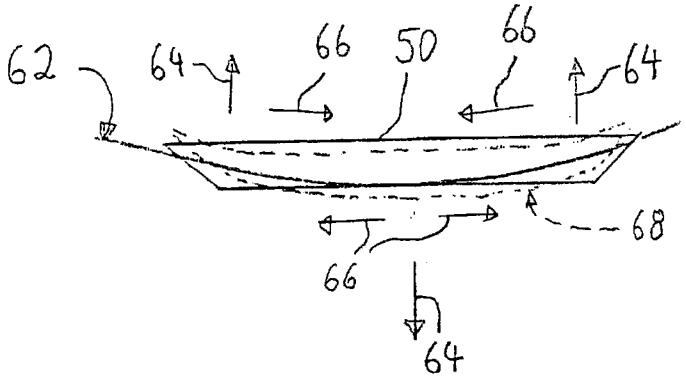
FIG. 2 (PRIOR ART)
FIG. 2 is a drawing of a prior art ocean going ship subjected to sagging.
Figure 3:
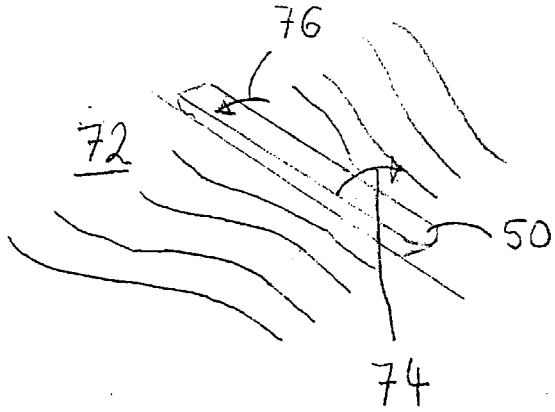
FIG. 3 (PRIOR ART)
FIG. 3 is a drawing of a prior art ocean going ship subjected to torsion.
Figure 4:
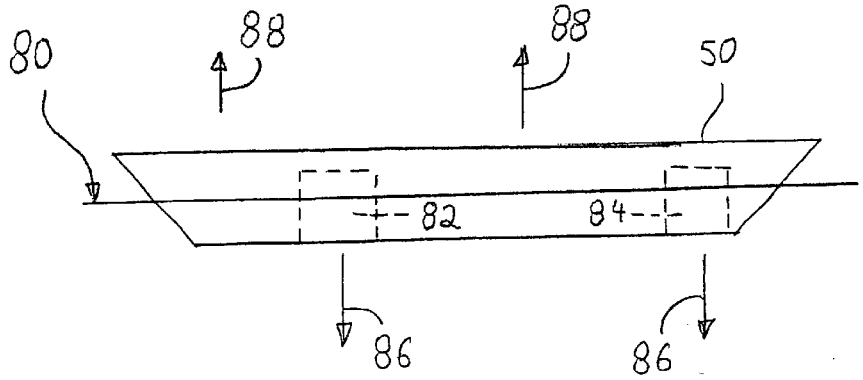
FIG. 4 is a drawing of a prior art ocean going ship subjected to shear.
Figure 5:
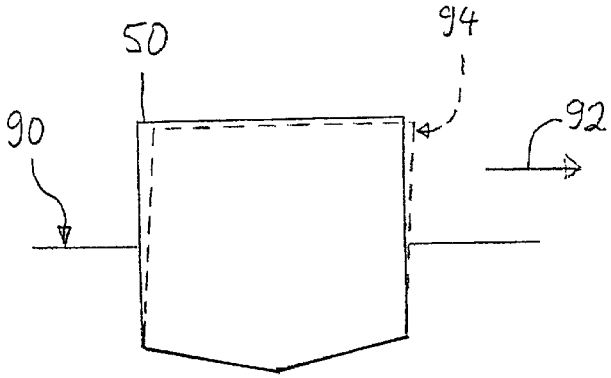
FIG. 5 is a drawing of a prior art ocean going ship subjected to racking.

Referring to FIG. 1, instead of a large hull hogging, the couplers of the oceantrain are stretched. Referring to FIG. 2, instead of a large hull sagging, the couplers of the oceantrain are compressed. Referring to FIG. 3, instead of a large hull being torsioned, it is the couplers that are torsioned. All these stresses to the couplers cause fatigue to them.

This is another important advantage of the invention. No matter how the couplers are made, they are inexpensive to replace multiple times, which makes the oceantrain of the invention have a long, economical service life compared to an ocean going freighter of similar total tonnage.

There are a number of ways to implement couplers for the oceantrain of the invention. First, the elongate portions can be rigid, such as a probe. This prevents collisions between adjacent ships, but presents the problem of the joints being biased to moving in all directions, as the two adjacent ships are changing relative position with respect to each other. Accordingly much art is known on joints that attach the ends of the elongate portion rotatably to each of the hulls, to follow the changing bias.

In another embodiment of the invention, the elongate portion is flexible, such as a towing cable or chain. An advantage of using a flexible elongate portion is that the joint need to be special such as to accommodate relative motion. The cable can be made from cables that are used for the construction of suspension bridges.

However, a flexible cable will make it more necessary to ensure that neighboring module ships do not approach each other too much, which can happen in the instance of the waves of FIG. 2. The invention ensures this by monitoring closely and continuously the positions of the ships relative to each other, as seen below.

Figure 9:
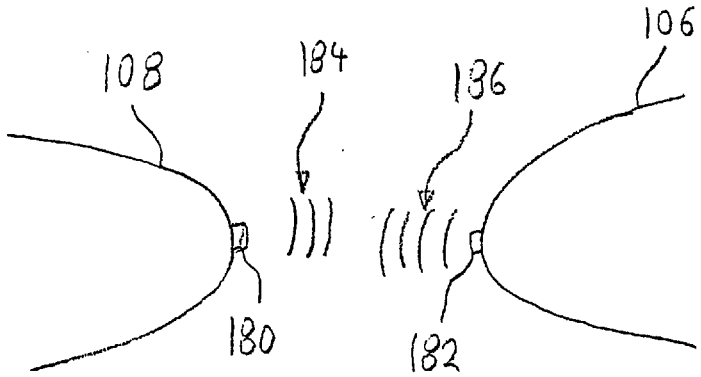
FIG. 9 is a top view of two adjacent vessels in an oceantrain of the invention, where the towed ship includes a range finder for determining the distance to the towing ship.

Referring to FIG. 9, a means is described for helping prevent collisions. Cargo ship 108 includes at its bow a range finder 180 aimed generally forward. The range finder determines distance information of the hull to the stern of ship 106 that tows ship 108. The range finder is made by a transmitter that transmits waves 184 and receives reflected waves 186. Therefore it determines the distance, as is known in the art. The computation can happen in the ship's computer.

Ideally a tuned radar reflector 182 (such as a dipole) is included at the stern of each ship. The reflector reflects waves 186 that are much stronger than all other returns. As such, they will prevent error readings in determining the intership distance.

The intership distance information is included in the operational status information, along with the mass and drag of the ship. Then navigational commands are generated that include differential adjustments to the throttling of each ship, often of a second order. This results in differential throttling between adjacent ships, which adjusts their relative distances on a continuous basis, and thus prevents proximity situations from arising.

Figure 10:
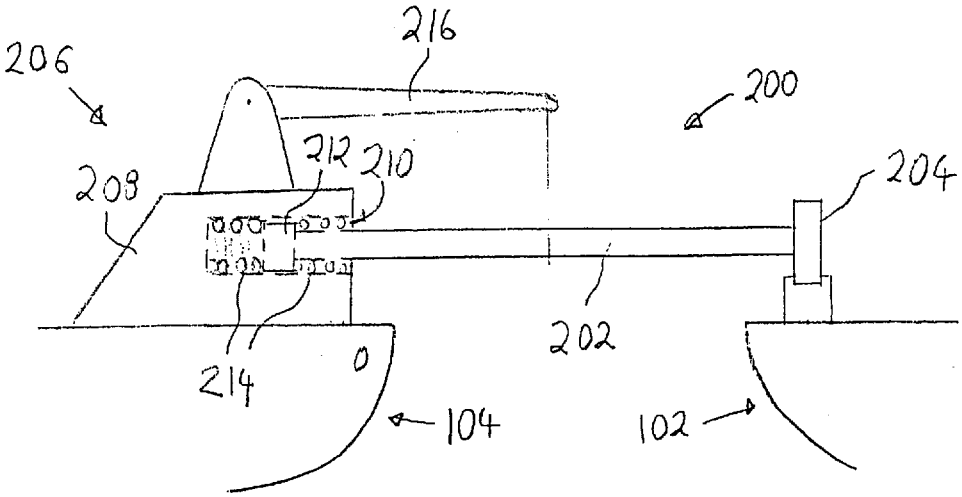
FIG. 10 is a side view of two ships coupled with a coupler made according to the present invention.

Referring to FIG. 10, the preferred embodiment is described for a coupler 200. The coupler includes an elongate member 202, and two joints 204, 206. The joints can be made as is known in the prior art to permit rotation member 202 with respect to each of the hulls.

In the preferred embodiment, joint 204 is a hemispherical locking collar. The collar is openable from the top, to drop in the end of member 202.

Further, joint 206 includes a base 208 with a channel 210. Member 202 terminates in a solid element 212 that is received in the channel. The element is moveable within the channel, and a spring 214 absorbs shock. The spring can be implemented in any number of ways. For example, either one or both of the joints can be coupled to the hull via a spring instead.

The spring alleviates pressure from the joints, when the coupler is stretched or compressed. Still, incorporating one or more springs in the ocean train presents other challenges. Interacting with the masses of the ships, the spring will create a periodic motion according to its spring constant. This can impose a periodically changing load on the engines, instead of the sudden changes as the whole mass is engaged. The problems of including a spring can be overcome at least in part by monitored closely and continuously the positions of the ships relative to each other as described above, and then adjusting them with differential throttling commands.

The base is openable from the top, for dropping element 212 in channel 210. A crane 216 is permanently stationed near the bow, behind base 208 as seen in FIG. 10. The crane suspends the elongate portion from the center of gravity. The crane is used for lifting the elongate portion for coupling and uncoupling, and stowing of the elongate portion near the bow and out of the way.

No matter how it is made, the elongate portion is long, preferably 10 feet or longer at least for the ocean voyage. This creates a safely large separation between the ships, which is desirable in the event that the oceantrain encounters waves such as those shown in FIG. 2.

Figure 11:
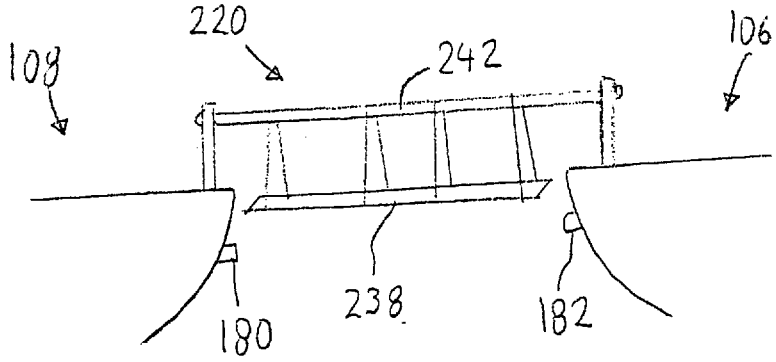
FIG. 11 is a side view of two ships coupled according to the present invention, wherein a catwalk is suspended from the coupler and a radar based range finder is being used.

The large separation makes it harder for a crewman to walk from one ship to another. Referring to FIG. 11, the coupler preferably includes a gimbaled catwalk 238 suspended from the elongate member 242 of coupler 220. The catwalk that completes a passageway between a deck of the towed ship to a deck of the towing ship.

If a range finder is also used with a catwalk, it should be located so that the waves avoid the catwalk, to prevent error readings. It can be placed below it. Alternately, the reflector 182 ensures that spurious reflections are minimized.

Method for Initiating Shipping Cargo Across an Ocean

A method is now described according to the invention. The method is for initiating shipping across an ocean a cargo that waits at a port of origin. The port can be upstream a navigable river that a prior art transoceanic cargo ship can not reach.

Figure 12:
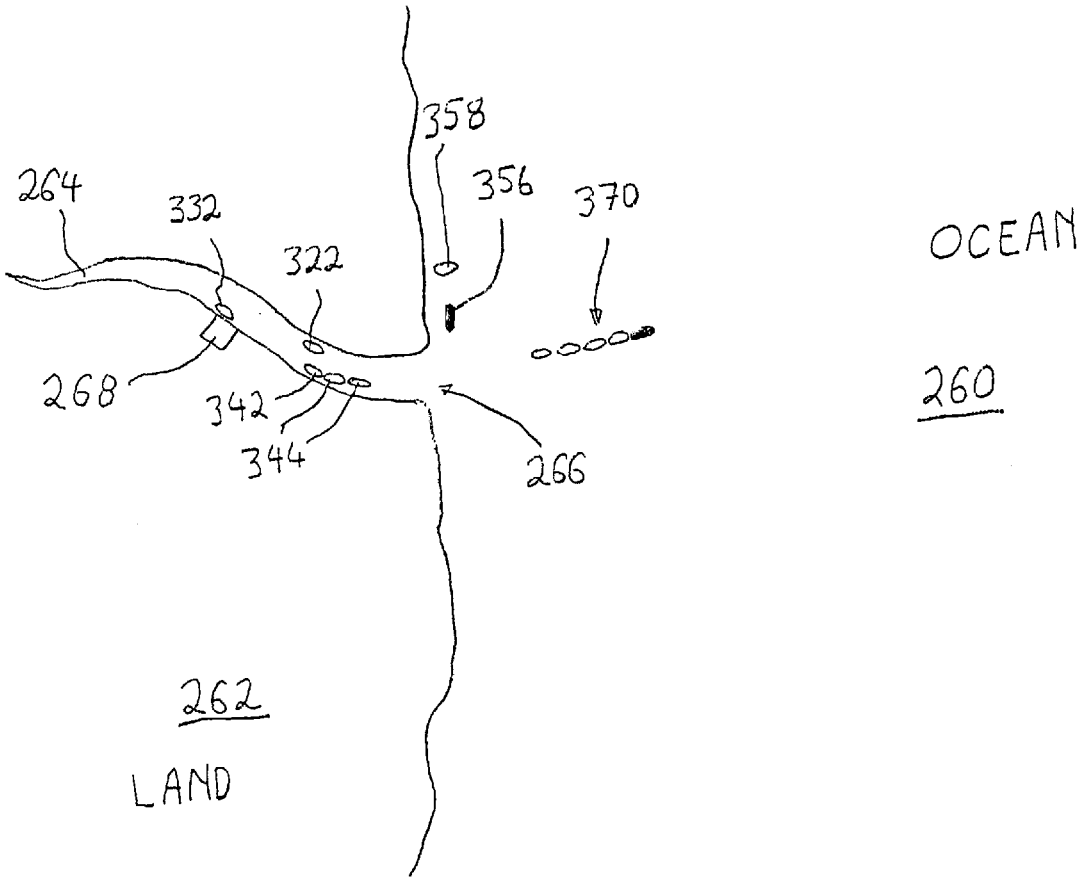
FIG. 12 is a map showing stages of initiating shipping a cargo from a port upstream a river across an ocean according to a method of the invention.

Referring to FIG. 12, a map shows an ocean 260, and landmass 262. The landmass includes a river 264 that has a mouth 266. A port of origin 268 is located upstream river 264, which means it is not located at the mouth of the river. Although generic locations are shown, it is understood that this description is applicable to all such locations.

The method is for initiating shipping a cargo from the port of origin 268 across the ocean 260. The method of the invention is only for initiating shipping. Actually completing shipping entails continuing towards the ocean, crossing it, reaching a port of destination, and unloading the cargo.

Figure 13:
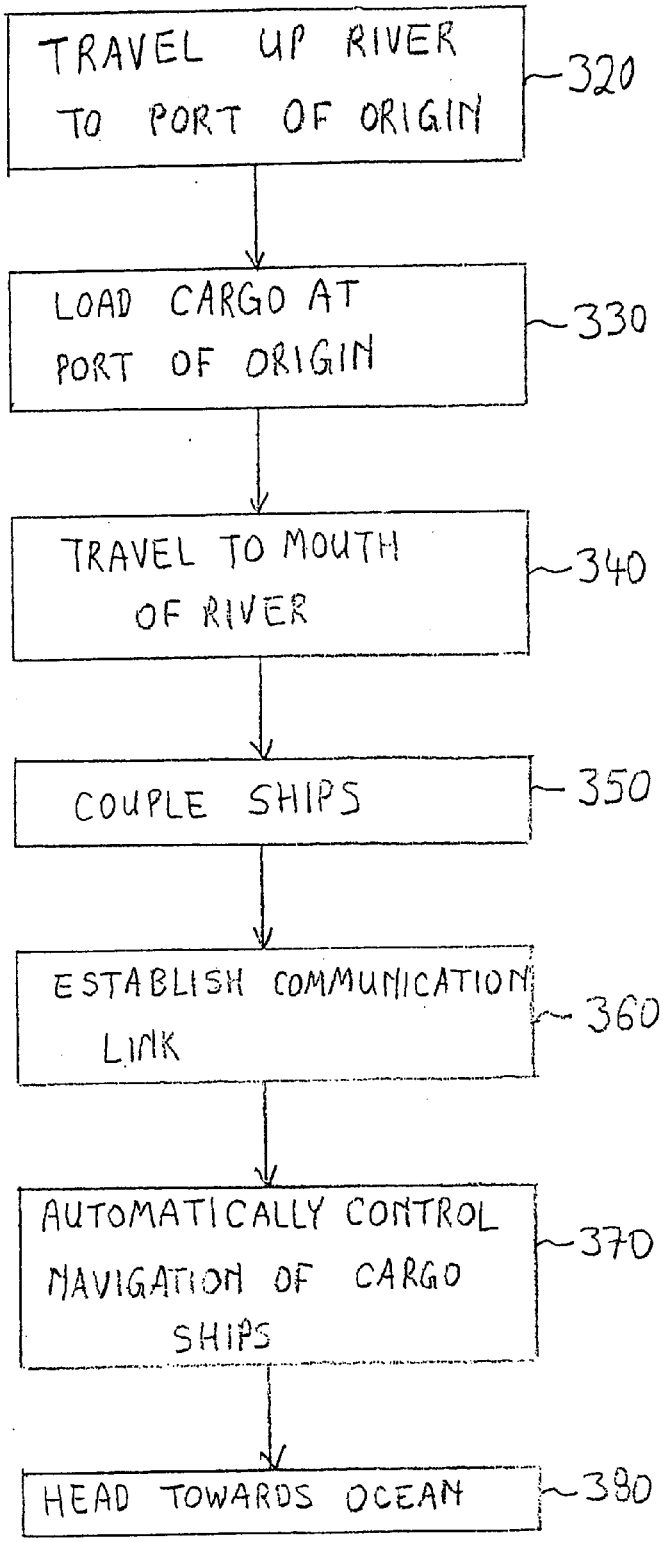
FIG. 13 is a flowchart showing steps of the method followed in FIG. 12.

The steps of the method are now described also with reference to FIG. 13. They are for initiating shipping a cargo from port 268 across the ocean.

According to step 320, a first cargo ship, seen as ship 322 in FIG. 12, travels from the mouth of the river 266 to port 268. The first cargo ship has a shallow draft enough to travel up the river, and an overhead low enough to clear bridges.

The cargo ship can perform step 320 either autonomously or controlled. By autonomously it is meant having its own pilot on board, who controls the navigational implements, and thus navigates the ship, which is propelled under its own power. By controlled it is meant either being towed, or controlled by a control ship, or both.

The cargo ship can perform step 320 either coupled or uncoupled with other ships. Coupled means that it is part of a towed convoy, such as an oceantrain of the invention. Uncoupled means either traveling autonomously or controlled remotely only by a control ship.

According to a step 330, the cargo is loaded onto the first cargo ship at the port of origin. The ship is seen as ship 332.

According to step 340, the first cargo ship then travels to the mouth of the river. The ship is seen as ship 342. Although it is seen coupled with ships 344, again this traveling can be autonomously.

According to a step 350, the first cargo ship is coupled with at least one other cargo ship. They are preferably also coupled with a tug to form an ocean train. For example, an uncoupled tug 356 waits for cargo ship 342 near the mouth 266 of river 264. It is further being joined by another cargo ship 358 that is coming from another location outside river 264.

As will be understood, the invention has high versatility. The oceantrain can be formed at any time before, during or after loading the cargo on the first ship. It can be formed while within the river, or outside of it, or when already in ocean waters. As such, even though these steps are presented seemingly serially, such is by way of illustration and not of limitation. There are thus many equivalent methods of practicing the invention.

According to an optional step 360, the first cargo ship also establishes a communication link with at least one other coupled ship, such as the tug. The communication link can be by connecting electrical connectors or establishing wireless communication, or a combination. Again, the step of establishing the communication link can be performed before or after the physical coupling of step 350, further adding to the versatility of implementing the invention. An oceantrain is established even if the physical coupling is not established, as long as the communication link is working to control the cargo ships. This means that control can start before coupling, and/or continue after uncoupling.

After either step 350 or step 360 or both, the first cargo ship is controlled at least in part by another ship. Control is either physical by towing, or electronic by controlling the navigation implements, or both.

According to an optional step 370, the navigation of the first cargo ship is automatically controlled. This is explained in more detail with reference to FIG. 14 later.

According to a step 380 of FIG. 13, the coupled first cargo ship heads from the mouth of the river towards the ocean. This completes the method of initiating shipping across the ocean. Past this point, the oceantrain is advantageously piloted only by the tug. The crew stays in the ocean tug during the ocean travel.

Figure 14:
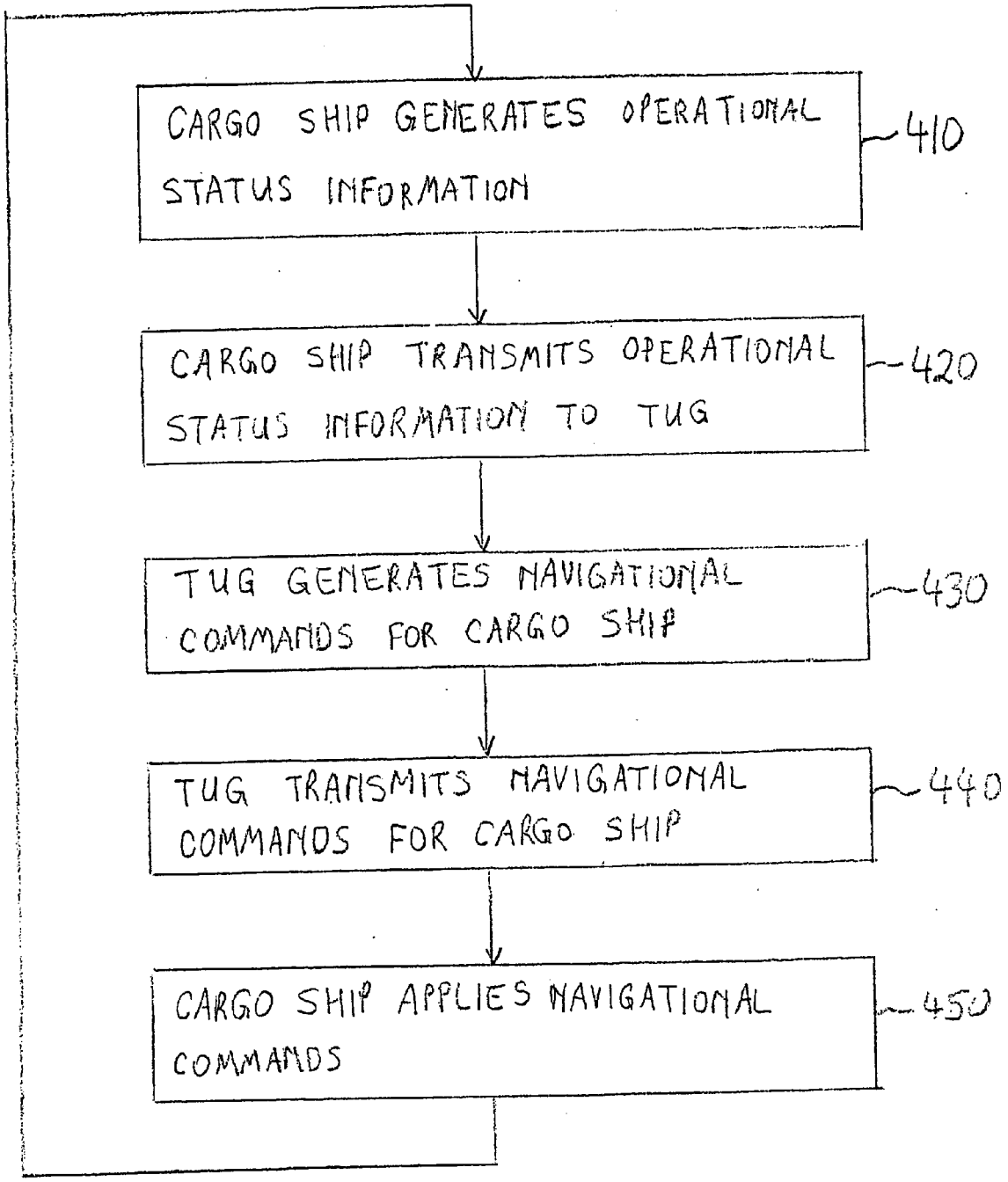
FIG. 14 is a flowchart showing substeps of a step of the method of FIG. 13 for automatically controlling cargo ships of the oceantrain.

FIG. 14 is a flowchart showing substeps of step 370.

According to optional step 410, each cargo ship generates operational status information. Optionally and preferably, the status information includes position information gleaned from a GPS receiver on board each cargo ship. The GPS receiver receives signals from a satellite. Further, the status information includes preferably includes range information about a relative distance between the first cargo ship and the second cargo ship. The range information is gleaned from a range finder associated with each cargo ship.

According to optional step 420, each cargo ship transmits the generated operational status information to the tug. Transmission is via the communication link, whether by wire or wireless.

According to step 430, the tug generates navigational commands for properly controlling the navigational implements of each cargo ship, whether coupled or not. Preferably the navigational commands take into account the received status information.

According to step 440, the tug transmits to the cargo ship the navigational commands via the communication link.

According to step 450, each cargo ship applies the received navigational commands to its own navigation implements.

Then execution returns to step 410 again. The cycle of these steps continues until interrupted. The cycle imposes course corrections and differential throttling adjustments to maintain the towed cargo ships at optimum distances from each other.

Given the construction of the ocean tug and the cargo ships of the invention, it will be appreciated that the ocean-train according to the preferred embodiment of the invention can travel through rivers and oceans just the same. This adds versatility in planning.

A person skilled in the art will be able to practice the present invention in view of the present description, where numerous details have been set forth in order to provide a more thorough understanding of the invention. In other instances, well-known features have not been described in detail in order not to obscure unnecessarily the invention.

Having illustrated and described the principles of the invention in a preferred embodiment thereof, it should be readily apparent to those skilled in the art that the invention can be modified in arrangement and detail without departing from such principles. All modifications coming within the spirit and scope of the accompanying claims are claimed as follows.

What is claimed is:

1. A traveling cargo ship controlled by a traveling control ship, the cargo ship comprising:

a hull for carrying cargo, wherein the hull is physically uncoupled from the control ship;

an engine for propelling the hull;

navigation implements controlling an operation of the engine and a direction of movement of the hull; and a wireless receiver for receiving from the control ship control signals containing navigational commands, wherein the received navigational commands are applied for controlling the navigation implements, a movement of the hull thereby being controlled by the control ship.

2. The cargo ship of claim 1, wherein the signals are received through a satellite.

3. The cargo ship of claim 1, further comprising:

a status signal generator for generating status signals representing operational status information of the cargo ship; and a wireless transmitter for transmitting the status signals to the control ship.

4. The cargo ship of claim 1, wherein when the control ship is moving in a first direction, the navigational commands control the navigation implements such that the hull is generally moving in the first direction.

5. The cargo ship of claim 1, wherein when the hull is additionally being towed by the control ship.

6. The cargo ship of claim 1, further comprising a range finder attached to the hull for determining distance information of the hull to the control ship, and wherein the distance information is included in the operational status information.

7. The cargo ship of claim 1, further comprising on board controls which can be operated to control the navigational implements instead of the control signals.

8. The cargo ship of claim 1, wherein the hull is constructed such that the cargo ship is oceanworthy.

9. The cargo ship of claim 1, further having a displacement in the range between 3,000 and 6,000 tons.

10. The cargo ship of claim 1, wherein the hull includes a refrigerated cargo capability.

11. The cargo ship of claim 10, further having a displacement in the range between 3,000 and 6,000 tons.

12. A The cargo ship of claim 1, wherein the hull includes a chemical containment capability.

13. The cargo ship of claim 12, further having a displacement in the range between 3,000 and 6,000 tons.

14. A method for initiating shipping a cargo across an ocean from a port of origin located upstream from a mouth of a river, the method comprising:

an uncoupled self propelling first cargo ship traveling upstream from the mouth of a river to the port of origin;

loading the cargo onto the uncoupled first cargo ship at the port of origin, the loaded first cargo ship then traveling to the mouth of the river;

coupling the first cargo ship with at least one other cargo ship and an ocean tug;

the coupled cargo ships and ocean tug heading from the mouth of the river towards the ocean, during which time the first cargo ship receives control signals that contain navigational commands, and applies the received navigational commands to navigation implements of the first cargo ship;

then uncoupling the first cargo ship from the other cargo ship; and then the first cargo ship continues receiving control signals that contain navigational commands, and applying the navigational commands to navigation implements of the first cargo ship.

15. The method of claim 14, wherein traveling upstream is performed by the first cargo ship traveling autonomously.

16. The method of claim 14, further comprising:

generating range information about a relative distance between the first cargo ship and the second cargo ship; and taking the range information into account when generating the navigational commands.

17. The method of claim 14, further comprising:

the first cargo ship receiving GPS information from a satellite; and taking the GPS information into account for generating the navigational commands.

18. The method of claim 14, wherein the control signals are received wirelessly.

* * * * *